United States Patent [19]

Sanka et al.

[11] 4,064,201

[45] Dec. 20, 1977

[54] ACCELERATING PUMP ACTUATING DEVICE FOR A CABURETOR

[75] Inventors: Tsugio Sanka, Wako; Toshimasa Shishido, Tokyo, both of Japan

[73] Assignee: Honda Giken Kogyo Kabushiki Kaisha, Tokyo, Japan

[21] Appl. No.: 713,968

[22] Filed: Aug. 12, 1976

[30] Foreign Application Priority Data

Aug. 18, 1975 Japan ..... 50-113020[U]

[51] Int. Cl.[2] ..... F02M 7/08

[52] U.S. Cl. ..... 261/34 A

[58] Field of Search ..... 261/34 A

[56] References Cited

U.S. PATENT DOCUMENTS

| | | | |
|---|---|---|---|
| 2,124,778 | 7/1938 | Hunt | 261/39 C |
| 3,362,694 | 1/1968 | Gould | 261/34 A |
| 3,689,036 | 9/1972 | Kikuchi et al. | 261/34 A |
| 3,730,495 | 5/1973 | Elam | 261/34 A |

FOREIGN PATENT DOCUMENTS

| | | | |
|---|---|---|---|
| 2,256,160 | 5/1973 | Germany | 261/34 A |
| 47-38326 | 9/1972 | Japan | 261/44 R |
| 318,828 | 9/1929 | United Kingdom | 261/34 A |
| 332,252 | 7/1930 | United Kingdom | 261/34 A |

*Primary Examiner*—Tim R. Miles

*Attorney, Agent, or Firm*—Haseltine, Lake & Waters

[57] ABSTRACT

A device including a cam member rotatable with the throttle opening and closing operation and a pump-actuating lever operable under the control of the cam member to discharge fuel to an acceleration spray nozzle opening into the intake air passage. The duration of the discharge stroke of the accelerating pump can be extended to any desired extent relative to the throttle opening movement for stable and efficient engine acceleration by selecting an appropriate cam contour.

2 Claims, 1 Drawing Figure

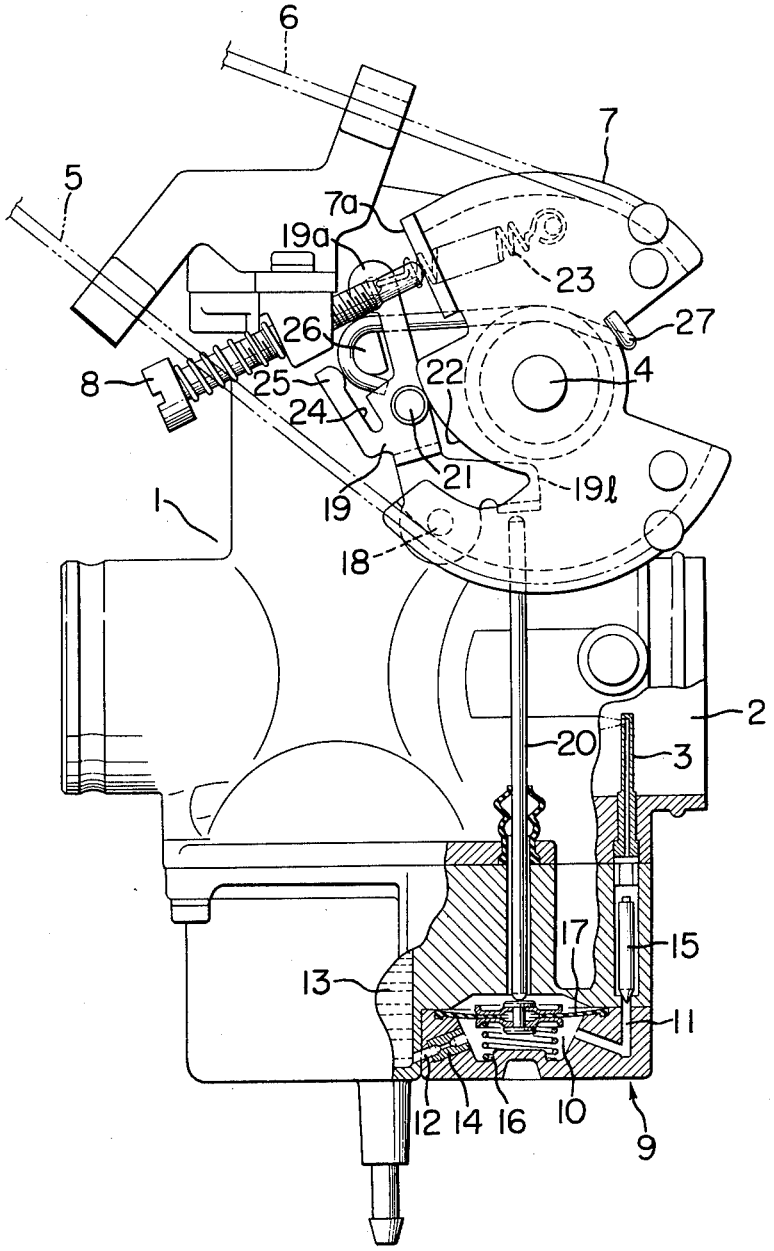
6
7
5
7a
19a
23
27
26
4
8
25
22
24
21
19ℓ
1
19
18
2
20
3
17
15
13
11
12
14
16
10
9

ACCELERATING PUMP ACTUATING DEVICE FOR A CABURETOR

FIELD OF THE INVENTION

This invention relates to carburetors of the type including an acceleration fuel spray nozzle and an accelerating pump connected therewith so that, when the throttle valve is quickly opened, acceleration fuel is sprayed into the air intake passage through the acceleration fuel spray nozzle to expedite the engine acceleration and more particularly to devices for actuating such accelerating pump.

Prior Art

With conventional devices, the accelerating pump has been operatively associated with the throttle valve simply through a linkage so that the accelerating pump completes its discharge stroke in an early stage of the accelerator pedal operation and does not respond to the pedal operation after the throttle valve has attained an intermediate opening. When such device is applied to a so-called "lean" engine, which is driven with a "lean" mixture having a fuel-air ratio lower than the theoretical level for reduction in amount of air-polluting constituents of the engine exhaust, the fuel-air mixture may become excessively lean upon any further pedal operation beyond the intermediate throttle opening and the engine acceleration be thrown into disorder. For such kind of engine, therefore, it is highly desirable that the discharge stroke of the accelerating pump be extended substantially over the whole range of throttle opening.

SUMMARY OF THE INVENTION

The present invention is intended to meet such requirement as described above and has for its object the provision of a novel and improved accelerating pump actuating device which is capable of imparting to the accelerating pump a discharge stroke as desired in accordance with the engine characteristics.

According to the present invention, the accelerating pump actuating device comprises a two-armed pump-actuating lever pivotally supported on the carburetor and having one arm operatively connected with the displacement member of the accelerating pump and a cam member operatively associated with the throttle valve for rotation therewith and held in camming engagement with the other arm of the pump-actuating lever so as to impart a discharge stroke to the accelerating pump as the throttle valve is turned to open. In a preferred embodiment of the present invention, the cam member takes the form of a pulley mounted on the carburetor for rotation in opposite directions under the pull of the throttle-opening and closing wires and having a contoured edge portion for camming engagement with the said other arm of the pump-actuating lever.

In another preferred embodiment of the present invention, a roller form of cam follower element is mounted on the other arm of the pump-actuating lever for contacting engagement with the contoured surface of the cam member.

The above and other objects, features and advantages of the present invention will become apparent from the following description when taken in conjuction with the accompanying drawing.

BRIEF DESCRIPTION OF THE DRAWING

The drawing includes a single FIGURE which represents a side elevational view, partly in cross section, of a preferred embodiment of the present invention.

DESCRIPTION OF THE PREFERRED EMBODIMENT

In the drawing, reference numeral 1 generally indicates a carburetor including an intake air passage 2 and an acceleration fuel spray nozzle 3 extending vertically to open into the intake air passage 2 on the upstream side of a throttle valve, not shown, and in the direction of air flow.

Rotatably supported on the carburetor 1 is a throttle-operating shaft 4 which is operatively connected with the throttle valve and on one end of which is fixedly mounted a pulley 7, which is rotatable in opposite directions under the pull of throttle-opening and closing wires 5 and 6. Formed on one side of the pulley 7 is an abutment surface **7*a* which faces the tip end of an idling stop screw 8 which in turn is adjustably fitted to the carburetor 1 on the outside thereof. With this arrangement, the throttle valve can be opened and closed by drawing the throttle wires 5 and 6 alternately to rotate the pulley 7clockwise and counter-clockwise, respectively, and, when the abutment surface 7*a* on the pulley 7 is in abutting engagement with the idling stop screw 8**, is held at a definite idling opening.

Reference numeral 9 generally indicates a displacement type accelerating pump provided on the carburetor 1 and in which a working chamber 10 is defined.

Connected with the pump chamber 10 are an outlet or discharge passage 11 and an inlet paggage 12 which is in fluid communication with a float chamber 13 at a level below the surface of fuel liquid held therein. As shown, the float chamber 13 is arranged immediately below the intake air passage 2. A constriction or orifice element 14 is inserted in the inlet passage 12 and a check valve 15 is inserted in the outlet passage 11, which extends generally upwardly from the pump chamber 10 to the acceleration fuel spray nozzle 3.

The accelerating pump 9 includes a displacement member in the form of a diaphragm 17 which defines the top wall of pump chamber 10 and is normally biased vertically upwardly by a restoring spring 16 arranged between the diaphragm 17 and the bottom wall of the pump chamber 10. The diaphragm 17 is operatively connected with a two-armed, bell crank type pump-actuating lever 19, pivotally supported at 18 on the carburetor 1 on the outside thereof, through the medium of a push rod 20, which is vertically arranged between the center portion of the diaphragm 17 and the lower arm **19*l* of the pump-actuating lever 19**.

The pump-actuating lever 19 has a roller form of cam follower element 21 mounted on one side of the upper arm **19*a* thereof for contacting engagement with a cam surface 22 provided on the periphery of the pulley 7 on one side thereof. A coiled tension spring 23 is arranged between the upper arm 19a and the pulley 7 to normally hold the cam follower roller 21 in contacting engagement with the cam surface 22. The upper arm 19*a* of pump-actuating lever 19 is slotted at 24 to define an adjustable abutting finger 25 on the other side of the arm 19*a*. The abutting finger 25 is engageable with a stop pin 26 fixed to the carburetor 1 on the outside thereof to define an upper limit for the rocking movement of the pump-actuating lever 19**.

Description will next be made of the operation of the embodiment described above.

First, when the throttle-opening wire 5 is drawn to turn the pulley 7 clockwise, as viewed in the drawing, in order to accelerate the engine, the cam 22 formed on the pulley slides over the cam follower roller 21, which is carried on the upper arm 19*a* of pump-actuating lever 19, to allow the latter to rock clockwise relative to the pulley 7 under the bias of coiled tension spring 23 as the roller 21 proceeds along the contour of cam surface 22 toward its bottom portion, that is, in a direction such that the distance of the roller 21 from the axis of rotation of the pulley 7 decreases.

Simultaneously with this, the diaphragm 17 in the accelerating pump 9 is driven downwardly by the lower arm 19*l* of pump-actuating lever 19 through the medium of the push rod 20 to compress the liquid fuel held in the pump chamber 10 with the aid of the constriction 14 inserted in the fuel inlet passage 12 and the fuel liquid thus pressurized is forced into the outlet passage 11 and discharged through the check valve 15 to be sprayed into the intake air passage 2 through the acceleration fuel spray nozzle 3 as a squirt of acceleration fuel serving to expedite the engine acceleration.

Subsequently, when the throttle-closing wire 6 is drawn to turn the pulley 7 counterclockwise, the pump-actuating lever 19 is forced this time to turn counterclockwise under the control of the cam mechanism including cam 22 and cam surface follower roller 21 interacting this time contrariwise and the diaphragm 17 is relieved of the depressing force acting thereon and returns to its upper, normal position under the bias of restoring spring 16. Simultaneously with this, the pump chamber 10 is reduced in pressure, causing a flow of fuel from the float chamber 13 into the pump chamber 10 through the inlet passage 12 in preparation for the next engine acceleration.

It will be readily appreciated from the foregoing description that, according to the present invention, the accelerating pump 9 is given a discharge stroke under the control of a cam surface mechanism including cam 22 operatively associated with the throttle valve to turn in either direction and the device of the present invention is applicable to a wide variety of engines as the fuel discharge characteristic of the accelerating pump can be freely determined relative to the range of throttle opening by employing an appropriate design of cam coutour and, as desired for a "lean" engine, the discharge stroke of the accelerating pump can be readily extended substantially over the whole throttle range.

Though one preferred embodiment of the present invention has been shown and described, it will be apparent to those skilled in the art that many changes and modifications may be made therein without departing from the spirit of the invention or the scope of the appended claims.

What is claimed is:

1. In a carburetor of the type including an acceleration fuel spray nozzle opening into an intake air passage and an accelerating pump operable to discharge fuel to the acceleration fuel spray nozzle in response to the throttle opening operation of a throttle valve associated therewith, an accelerating pump actuating device comprising a two-armed pump-actuating lever pivotally supported on the carburetor and having one arm operatively connected with the displacement member of the accelerating pump, a rotatable cam member operatively coupled in rotation with a rotatable shaft of the throttle valve for therewith, said cam member being in camming engagement with the other arm of said pumpactuating lever so as to impart a discharge stroke to the accelerating pump as the throttle valve is turned open, said cam member being mounted on the carburetor for rotation in opposite directions under the pull of throttle-opening and closing wires and having a contoured edge portion for camming engagement with said other arm of said pump-actuating lever, a roller cam follower element mounted on said other arm of said pump-actuating lever for contacting engagement with said contoured edge portion of said cam member and means resiliently connecting said cam member and said two-armed lever for common pivotal movement.

2. A device as claimed in claim 1 wherein said two-armed lever has a slot with an abutting finger engageable with a stop to define a limit for pivotal movement of said lever.

* * * * *